US011731250B2

(12) United States Patent
Forsberg et al.

(10) Patent No.: US 11,731,250 B2
(45) Date of Patent: Aug. 22, 2023

(54) POWER TOOL ATTACHMENT PART

(71) Applicant: ATLAS COPCO INDUSTRIAL TECHNIQUE AB, Stockholm (SE)

(72) Inventors: Per Ingemar Forsberg, Värmdö (SE); Wojtek Malinowski, Danderyd (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 332 days.

(21) Appl. No.: 17/258,788

(22) PCT Filed: Jun. 20, 2019

(86) PCT No.: PCT/EP2019/066333

§ 371 (c)(1),
(2) Date: Jan. 8, 2021

(87) PCT Pub. No.: WO2020/011509

PCT Pub. Date: Jan. 16, 2020

(65) Prior Publication Data

US 2021/0283752 A1 Sep. 16, 2021

(30) Foreign Application Priority Data

Jul. 12, 2018 (SE) ..... 1850892-9

(51) Int. Cl.

| | |
|---|---|
| ***B25B 21/00*** | (2006.01) |
| ***B25F 5/00*** | (2006.01) |
| ***B25B 23/00*** | (2006.01) |

(52) U.S. Cl.

CPC ..... *B25B 21/002* (2013.01); *B25B 21/00* (2013.01); *B25F 5/001* (2013.01); *B25B 23/0035* (2013.01)

(58) Field of Classification Search

CPC .... B25B 21/002; B25B 23/0035; B25F 5/001
See application file for complete search history.

(56) References Cited

U.S. PATENT DOCUMENTS 9,981,366 B2 * 5/2018 Todd ..... B25B 23/12
10,099,350 B2 * 10/2018 Gates ..... B25B 17/00
(Continued)

FOREIGN PATENT DOCUMENTS

JP S4934490 U 3/1974
JP 2008012666 A 1/2008
(Continued)

OTHER PUBLICATIONS

International Preliminary Report on Patentability (IPRP) dated Jun. 22, 2020 issued in International Application No. PCT/EP2019/066333.

(Continued)

*Primary Examiner* — David B. Thomas
(74) *Attorney, Agent, or Firm* — Holtz, Holtz & Volek PC

(57) ABSTRACT

A power tool attachment part for a power tool includes an elongated housing including an upper housing part and a lower housing part interconnected with the upper housing part. An input gear wheel for connection to an output shaft of the power tool is arranged at a first end of the housing. An output gear wheel with an output connection is arranged at a second end of the housing. At least one intermediate gear wheel is arranged inside the housing to transmit rotation of the input gear wheel to the output gear wheel. A magnet is arranged in the elongated housing, wherein the magnet is arranged to collect ferromagnetic particles.

15 Claims, 2 Drawing Sheets

(56) References Cited

U.S. PATENT DOCUMENTS

| | | | |
|---|---|---|---|
| 2008/0006422 | A1 | 1/2008 | Berghauser et al. |
| 2013/0180364 | A1 | 7/2013 | Galat |
| 2017/0144277 | A1 | 5/2017 | Söderlund et al. |

FOREIGN PATENT DOCUMENTS

| | | | |
|---|---|---|---|
| JP | 2017518890 | A | 7/2017 |
| WO | 2015181011 | A1 | 12/2015 |

OTHER PUBLICATIONS

International Search Report (ISR) dated Oct. 10, 2019 issued in International Application No. PCT/EP2019/066333.
Written Opinion dated Oct. 10, 2019 issued in International Application No. PCT/EP2019/066333.
U.S. Appl. No. 17/258,799; First Named Inventor: Ulf Mikael Eriksson; Title: "Attachment Part for a Power Tool and a Tool Assembly"; filed Jan. 8, 2021.
Japanese Office Action (and an English language translation thereof) dated Jun. 12, 2023, issued in counterpart Japanese Application No. 2021-500927.

* cited by examiner

POWER TOOL ATTACHMENT PART

TECHNICAL FIELD

The invention relates to a power tool attachment part for transmitting a torque from a power tool to a joint.

BACKGROUND

A power tool attachment part is generally used in confined spaces where it is not possible to use an ordinary power tool, due to that it is difficult to access the bolt or nut of the joint to be tightened. A power tool attachment part is also known as a crowfoot, a front part attachment or an offset attachment. Below it will be referred to as a power tool attachment part.

A power tool attachment part includes a number of gear wheels that transmit a rotating movement from an input gear wheel to an output gear wheel. The gear wheels are generally located in a straight row, teeth against teeth, inside an elongate housing. In addition to the thickness of the housing wall the length of the attachment part corresponds to the sum of the width of the gear wheels. The power tool attachment part is generally used in confined spaces. Therefore, the size of the power tool attachment part is an important feature. Thus there is a desire to use small gear wheels. Small gear wheels are more sensitive to wear than larger gear wheels. Thus a disadvantage of conventional power tool attachments are that the power tool attachments are sensitive to wear that can cause the power tool attachments to malfunction.

Hence, there is a need for an improved power tool attachment part that can solve or at least mitigate the above mentioned problem.

SUMMARY

An object of the invention is to provide an attachment part with increased durability compared to conventional attachment parts.

This object is achieved by the invention according to claim 1, which relates to power tool attachment part for tightening joints. The power tool attachment part comprises an elongate housing including an upper housing part and a lower housing part interconnected with the upper housing part. An input gear wheel for connection to an output shaft of a power tool, which input gear wheel is arranged at a first end of the housing. The power tool attachment part further comprises an output gear wheel with an output connection, where the output gear wheel is arranged at a second end of the housing. At least one intermediate gear wheel is arranged inside the housing to transmit the rotation of the input gear wheel to the output gear wheel. The power tool attachment part is characterised in that a magnet is arranged in the elongate housing, wherein the magnet is arranged to collect ferromagnetic particles In one specific embodiment of the invention the magnet is arranged in the lower housing part.

In another embodiment of the invention the magnet is arranged in the upper housing part.

In yet another embodiment of the invention the magnet is arranged in the lower housing part under an inference between two gear wheels.

The magnet may hence be arranged below a region where to gear wheels engage in the lower housing part. Alternatively, or additionally, the magnet may be arranged above a region where to gear wheels engage in the upper housing part.

In one specific embodiment of the invention the elongate housing comprises a detachable cap, wherein the magnet is arranged in the detachable cap.

In another embodiment of the invention the detachable cap is arranged under the input gear wheel, wherein the magnet is arranged in the detachable cap.

In yet another embodiment of the invention the detachable cap is part of an arrangement holding the upper housing part and the lower housing part together, wherein the magnet is arranged in the detachable cap.

According to one embodiment the power tool attachment part comprising an interface head configured to be attached to an adaptor, and a sleeve configured to receive the input gear wheel and provided with at least one radially outwards extending clamping flange configured to engage with the interface head, wherein the upper housing part and the lower housing part each has a through-opening configured to receive the sleeve, wherein the detachable cap is configured to engage with the sleeve to thereby attach the interface head and the detachable cap to the elongate housing.

Alternatively, the power tool attachment part may comprising an interface head configured to be attached to an adaptor, wherein the interface head has a sleeve configured to receive the input gear wheel, wherein the upper housing part and the lower housing part each has a through-opening configured to receive the sleeve, wherein the detachable cap is configured to engage with the sleeve.

According to one embodiment the sleeve and the detachable cap form a chamber for receiving the input gear wheel.

According to one embodiment the chamber opens into the elongate housing formed by the upper housing part and the lower housing part.

According to one embodiment the detachable cap has an inner cap surface configured to receive the magnet.

According to one embodiment the inter cap surface is arranged adjacent to the input gear wheel.

Other features and advantages of the invention will be apparent from the figure and from the detailed description of the shown embodiments.

SHORT DESCRIPTION OF THE DRAWINGS

In the following detailed description reference is made to the accompanying drawings, of which:

Figure 3:
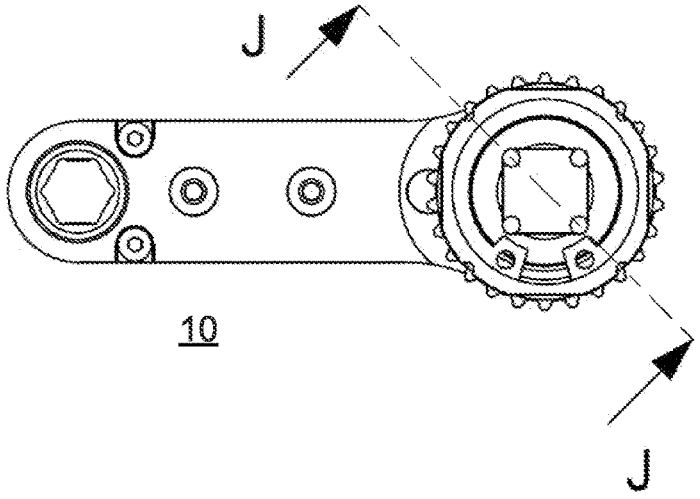
FIG. 3 is a top view of the power tool attachment part in FIG. 2.
Figure 4A:
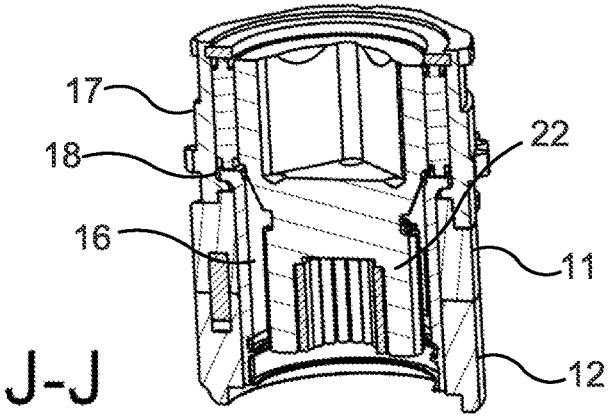
Figure 4B:
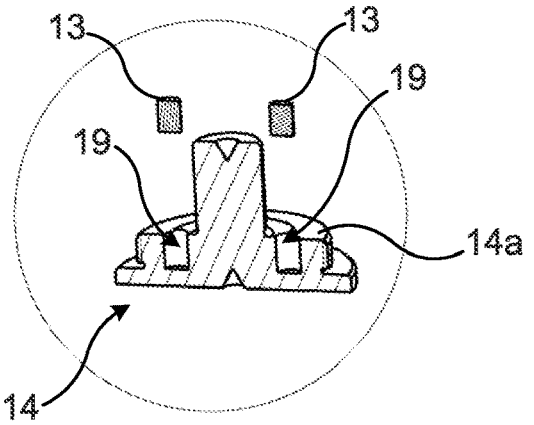

FIG. 4*a* shows a section along lines J-J in FIG. 3 with a detachable cap removed; and FIG. 4*b* shows the corresponding section of the detachable cap.

DETAILED DESCRIPTION

Figure 1:
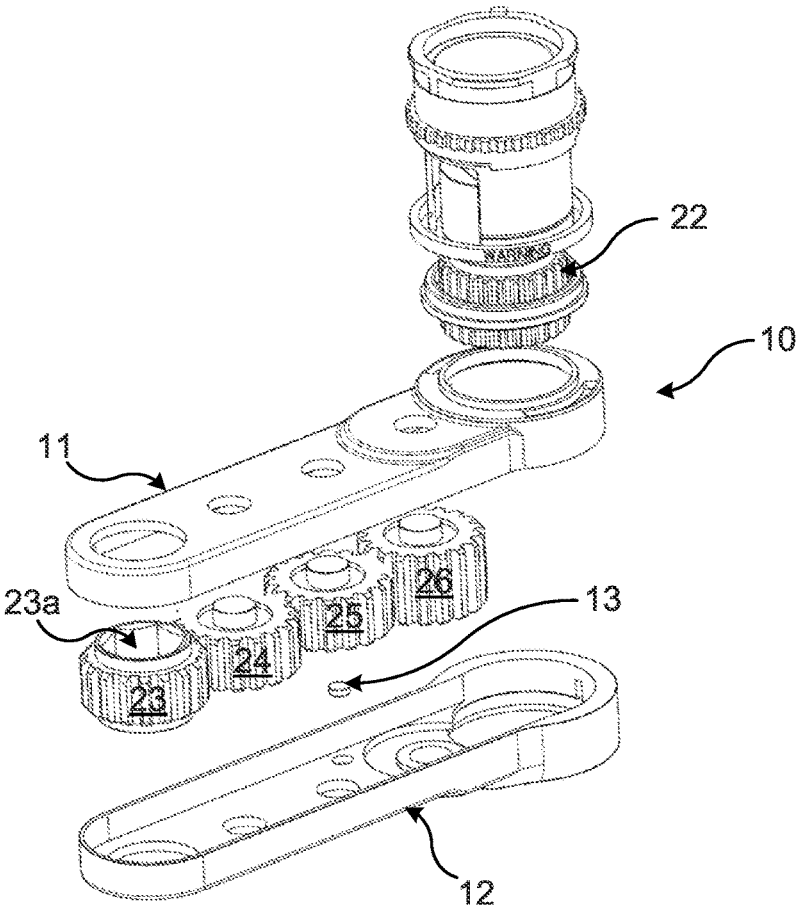
FIG. 1 shows a power tool attachment part according to an exemplary embodiment of the present disclosure.

In FIG. 1 an example of a power tool attachment part 10 is shown. The power tool attachment part 10 comprises an elongate housing 11, 12 comprising an upper housing part 11 and a lower housing part 12. The upper housing part 11 is interconnected with the lower housing part 12.

An attachment part for e.g. a power tool such as a power wrench is used in confined spaces where it may not be possible to use an ordinary power tool, due to that it is difficult or impossible to access the bolt or nut to be screwed.

Hence, the size of the attachment part is an important feature. Small gear wheels are more sensitive to wear than larger gear wheels.

The exemplified power tool attachment part 10 has a construction that will decrease the wear and increase the durability compared to a conventional attachment part of the same accuracy and torque capacity. This will be apparent from the description below.

In FIG. 1, the power tool attachment part 10 is shown in an exploded view. The power tool attachment part 10 comprises an input gear wheel 22 and an output gear wheel 23 arranged in the elongate housing 11, 12. The input gear wheel 22 is arranged at a first end of the elongate housing 11, 12. The output gear wheel 23 is arranged at a second end of the housing 11, 12.

The input gear wheel 22 is drivingly connected to the output gear wheel 23 via one or more intermediate gear wheels. In the present example, there are three intermediate gear wheels 24, 25, 26, which are arranged to transmit the rotation of the input gear wheel 22 to the output gear wheel 23.

The output gear wheel 23 comprises an output connection 23*a*. The output connection 23*a* may be configured to receive a wrench bit, a screw bit, a nut or screw head.

The power tool attachment part 10 comprises a magnet 13. The magnet 13 is arranged in the elongate housing 11, 12. The magnet 13 is arranged to collect ferromagnetic particles inside the housing 11, 12. Since the magnet 13 is arranged to collect ferromagnetic particles these particles are prevented from moving around inside the elongate housing 11, 12 and cause wear to the gear wheels 22, 23, 24, 25, 26. This will decrease the wear of the gear wheels 22-26 and thus increase the durability of the attachment part 10.

According to one exemplary embodiment the magnet 13 is arranged in the lower housing part 12. An advantage with this embodiment is that the ferromagnetic particles more easily can be collected by the magnet when the power tool attachment part 10 is in an upright position.

In yet another exemplary embodiment of the power tool attachment part 10 the magnet 13 is arranged in the lower housing part 12 under an inference between two gear wheels 22-26, i.e. in the interface between two engaging gear wheels 22-26.

In another exemplary embodiment of the power tool attachment part 10 the magnet 13 is arranged in the upper housing part 11. The power tool attachment part 10 is often moved around when used. The ferromagnetic particles will in this exemplary embodiment be collected by the magnet when the power tool attachment 10 is in an upside down position.

According to one embodiment, the power tool attachment part 10 may comprise a magnet 13 arranged in the upper housing part 11 and a magnet 13 arranged in the lower housing part 12.

In a further exemplary embodiment, the magnet is arranged in a detachable cap (not shown in FIG. 1) of the elongate housing 11, 12.

An advantage with this exemplary embodiment is that the magnet 13 can be cleaned when removing the detachable cap. In another exemplary embodiment the detachable cap is arranged under the input gear wheel 22. In a further exemplary embodiment of the power tool attachment part 10 the detachable cap is part of an arrangement holding the upper housing part 11 and the lower housing part 12 together. An advantage with this exemplary embodiment is that the magnet 13 can be cleaned without disassembling the upper housing part 11 from the interconnected lower housing part 12.

According to one exemplary embodiment the power tool attachment part 10 comprises several magnets placed at different positions in the elongate housing 11, 12.

Figure 2:
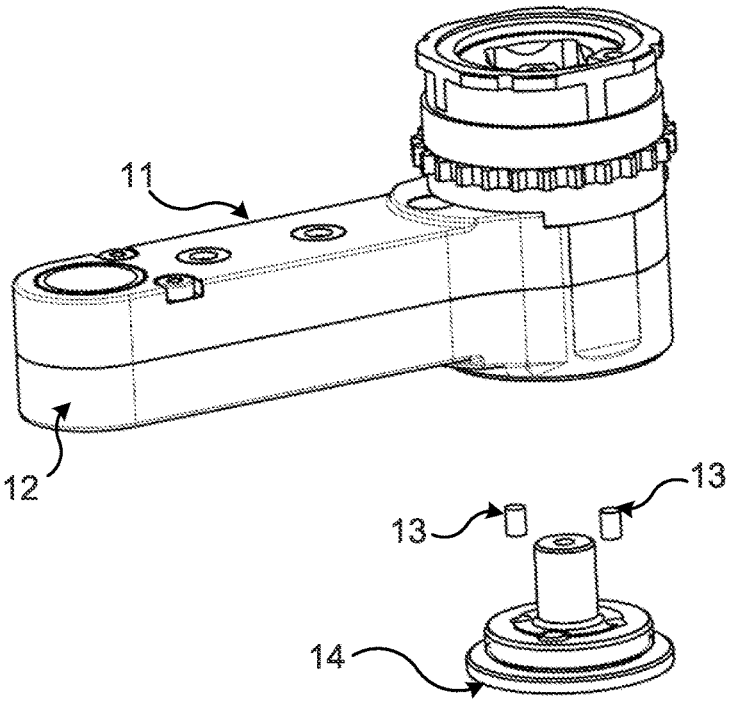
FIG. 2 shows the power tool attachment part in an essentially mounted state.

In FIG. 2 the power tool attachment part 10 according to a specific embodiment is shown. In this exemplary embodiment the power tool attachment part 10 comprises a detachable cap 14. In FIG. 2, the power tool attachment part 10 is shown with the upper housing part 11 arranged on the lower housing part 12, such that the interior of the attachment part 10 is not visible. However the detachable cap 14 is shown detached from the power tool attachment part 10.

FIG. 3 shows a top view of the power tool attachment part 10 in FIG. 2. FIG. 4*a* shows the section along lines J-J in FIG. 3 without the detachable cap 14 and FIG. 4*b* shows the corresponding section of the detachable cap 14.

The upper housing part 11 and the lower housing part 12 may each have a through-opening, which when the upper housing part 11 and the lower housing part 12 are assembled with each other are aligned. The through-openings are arranged in the first end of the elongate housing 11, 12. The through-openings are configured to receive the input gear wheel 22.

The exemplified power tool attachment part 10 comprises a sleeve 16 configured to be received by the through-openings. The exemplified power tool attachment part 10 also comprises an interface head 17 configured to engage with an adaptor, such as an indexing adaptor. The sleeve 16 has one or more radially outwards extending clamping flanges 18 configured to engage with the interface head 17. The detachable cap 14 comprises attachment means for attaching the detachable cap 14 to the sleeve 16. For example, the detachable cap 14 may be attached to the sleeve 16 by means of a threaded connection. The interface head 17, the upper housing part 11, the lower housing part 12 and the detachable cap 14 may hence by means of this configuration be fastened to each other.

According to one variation, the interface head and the sleeve may be integrated. The detachable cap 14 is also in this example configured to be attached to the sleeve.

The sleeve 16 may have a circumferential opening configured to open towards an interior space of the interconnected upper housing part 11 and lower housing part 12. In this manner, the input gear wheel 22 is able to interact with intermediate gear wheels 24-26 arranged in the elongate housing formed by the upper housing part 11 and the lower housing part 12.

The sleeve 16 and the detachable cap 14 may form a chamber in which the input gear wheel 22 is arranged. The detachable cap 14 may have an inner cap surface 14*a* arranged adjacent to the input gear wheel 22 when the power tool attachment part 10 is in a mounted state.

The inner cap surface 14 may be provided with one or more magnet openings 19. The one or more magnet openings 19 may extend parallel with the central axis of the detachable cap 14. The one or more magnet openings 19 may be provided with a respective magnet 13. The magnet or magnets 13 may be configured to be press fit in the one or more magnet openings 19. Ferromagnetic particles from e.g. the input gear wheel 22 in the chamber may thereby be collected by the magnet(s) 13.

In the example shown in FIGS. 2-4*b* two magnets 13 are arranged in the detachable cap 14. The detachable cap 14 can however, in other exemplary embodiment, be configured to receive more than two magnets 13 or fever than two magnets 13. The power tool attachment part 10 comprises the same number of magnets 13 as there are magnet openings 19.

Above, the invention has been described with reference to two specific embodiments. The invention is however not limited to either of these embodiments. It is obvious to a person skilled in the art that the invention may be modified within its scope, which is defined by the following claims.

The invention claimed is:

1. A power tool attachment part for a power tool, the power tool attachment part comprising:

an elongated housing including an upper housing part and a lower housing part interconnected with the upper housing part;

an input gear wheel for connection to an output shaft of the power tool, wherein the input gear wheel is arranged at a first end of the housing;

an output gear wheel with an output connection, wherein the output gear wheel is arranged at a second end of the housing;

at least one intermediate gear wheel, which is arranged inside the housing to transmit rotation of the input gear wheel to the output gear wheel;

a magnet arranged in the elongated housing, wherein the magnet is arranged to collect ferromagnetic particles; and a detachable cap;

wherein the magnet is arranged in the detachable cap.

2. The power tool attachment part according to claim 1, wherein the detachable cap is arranged under the input gear wheel.

3. The power tool attachment part according to claim 1, wherein the detachable cap is part of an arrangement holding the upper housing part and the lower housing part together.

4. The power tool attachment par according to claim 3, further comprising:

an interface head configured to be attached to an adaptor; and a sleeve configured to receive the input gear wheel and provided with at least one radially outwards extending clamping flange configured to engage with the interface head;

wherein each of the upper housing part and the lower housing part has a through-opening configured to receive the sleeve, and wherein the detachable cap is configured to engage with the sleeve to thereby attach the interface head and the detachable cap to the elongate housing.

5. The power tool attachment part as claimed in claim 4, wherein the sleeve and the detachable cap form a chamber for receiving the input gear wheel.

6. The power tool attachment part as claimed in claim 5, wherein the chamber opens into the elongate housing formed by the upper housing part and the lower housing part.

7. The power tool attachment part according to claim 4, wherein the detachable cap has an inner cap surface configured to receive the magnet.

8. The power tool attachment part as claimed in claim 7, wherein the inner cap surface is arranged adjacent to the input gear wheel.

9. The power tool attachment part according to claim 3, further comprising:

an interface head configured to be attached to an adaptor, wherein the interface head has a sleeve configured to receive the input gear wheel, wherein each of the upper housing part and the lower housing part has a through-opening configured to receive the sleeve, and wherein the detachable cap is configured to engage with the sleeve.

10. The power tool attachment part as claimed in claim 9, wherein the sleeve and the detachable cap form a chamber for receiving the input gear wheel.

11. The power tool attachment part as claimed in claim 10, wherein the chamber opens into the elongate housing formed by the upper housing part and the lower housing part.

12. The power tool attachment part according to claim 9, wherein the detachable cap has an inner cap surface configured to receive the magnet.

13. The power tool attachment part as claimed in claim 12, wherein the inner cap surface is arranged adjacent to the input gear wheel.

14. The power tool attachment part according to claim 1, wherein the power tool attachment part comprises several magnets.

15. The power tool attachment part according to claim 14, wherein the several magnets are placed at different positions in the elongate housing.

* * * * *